US009280122B2

(12) United States Patent
Matsumoto

(10) Patent No.: US 9,280,122 B2
(45) Date of Patent: Mar. 8, 2016

(54) PRINTING APPARATUS, METHOD FOR CONTROLLING PRINTING APPARATUS, AND RECORDING MEDIUM

(71) Applicant: CANON KABUSHIKI KAISHA, Tokyo (JP)

(72) Inventor: Akihiro Matsumoto, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/635,766

(22) Filed: Mar. 2, 2015

(65) Prior Publication Data

US 2015/0253719 A1 Sep. 10, 2015

(30) Foreign Application Priority Data

Mar. 4, 2014 (JP) ..... 2014-041684

(51) Int. Cl.
*G03G 15/00* (2006.01)

(52) U.S. Cl.
CPC ..... *G03G 15/80* (2013.01); *G03G 15/5004* (2013.01); *G03G 15/5016* (2013.01); *G03G 15/5091* (2013.01)

(58) Field of Classification Search
CPC ..... G03G 15/5004; G03G 15/5016
See application file for complete search history.

(56) References Cited

U.S. PATENT DOCUMENTS 9,069,313 B2 * 6/2015 Ogata et al.
2012/0328319 A1 * 12/2012 Ogata et al. ..... 399/75
2015/0006927 A1 * 1/2015 Ono et al. ..... 713/320

FOREIGN PATENT DOCUMENTS

JP 2012-177796 A 9/2012

* cited by examiner

*Primary Examiner* — Roy Y Yi
(74) *Attorney, Agent, or Firm* — Canon USA, Inc. IP Division

(57) ABSTRACT

A printing apparatus capable of shifting a power state to a second power state where power consumption is lower than a first power state includes detecting a heat source approaching the printing apparatus, calculating an average temperature of respective areas near the printing apparatus, specifying a current position of the heat source based on the calculated average temperature, calculating a distance between the current position and a predetermined reference point, determining whether the heat source is moving to pass by the printing apparatus, determining whether the heat source is approaching the printing apparatus, and shifting, when it is determined that the heat source is approaching the printing apparatus, the power state of the printing apparatus from the second power state to the first power state.

20 Claims, 19 Drawing Sheets

FIG. 3A
ENTRY INTO DETECTION AREA
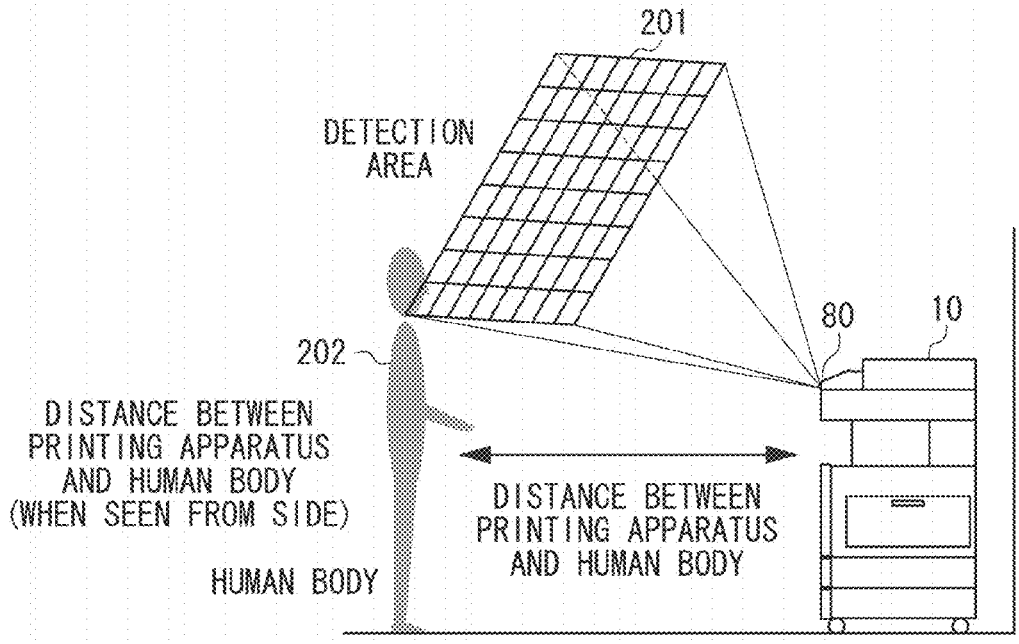
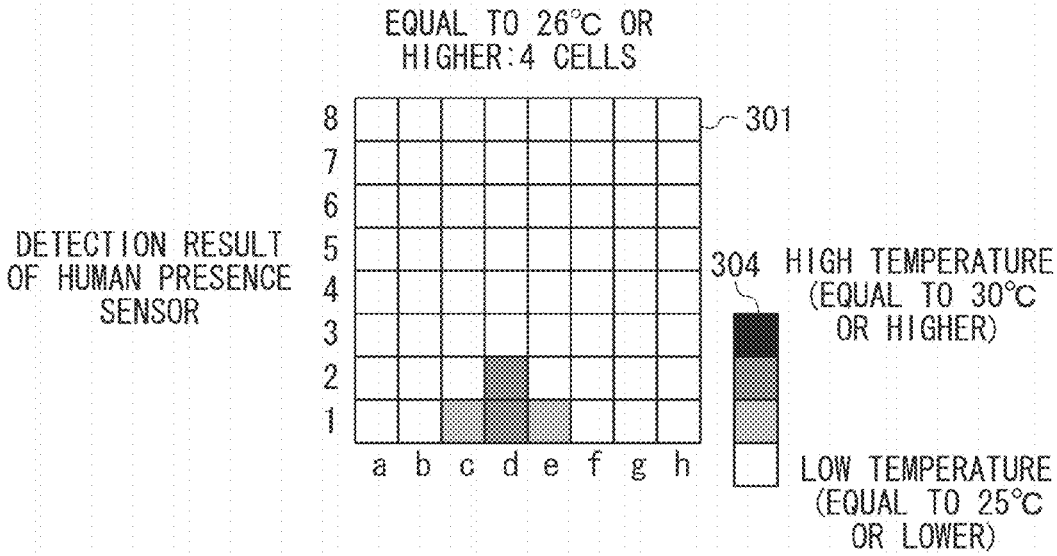

FIG. 3B
APPROACHING TO PRINTING APPARATUS
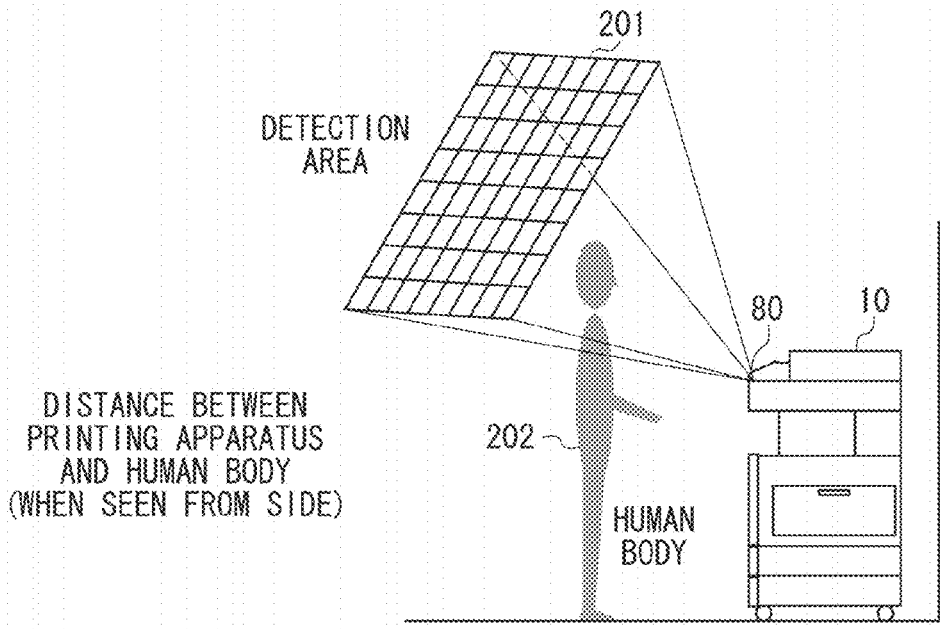
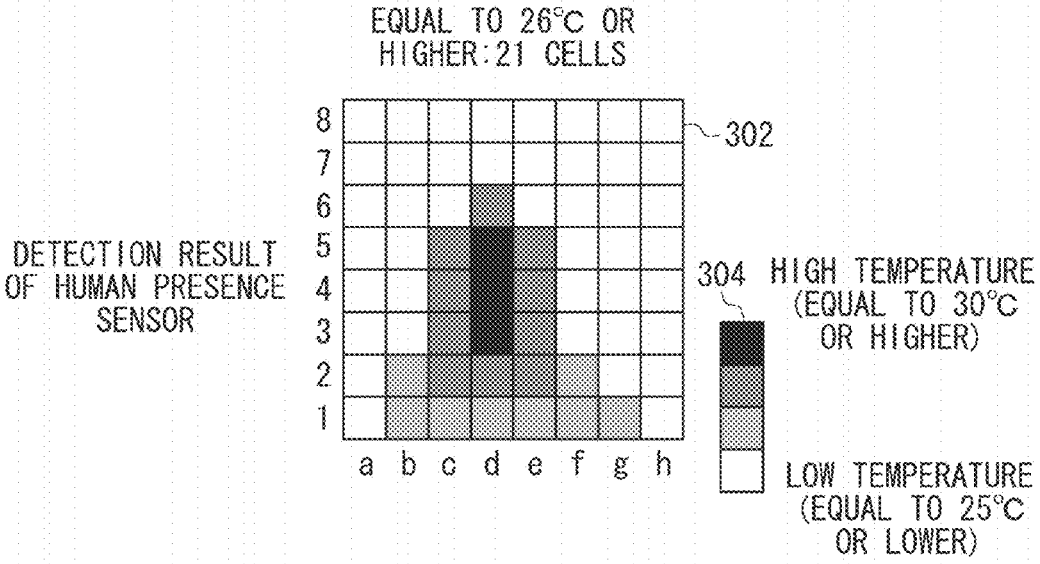

FIG. 3C
USING PRINTING APPARATUS
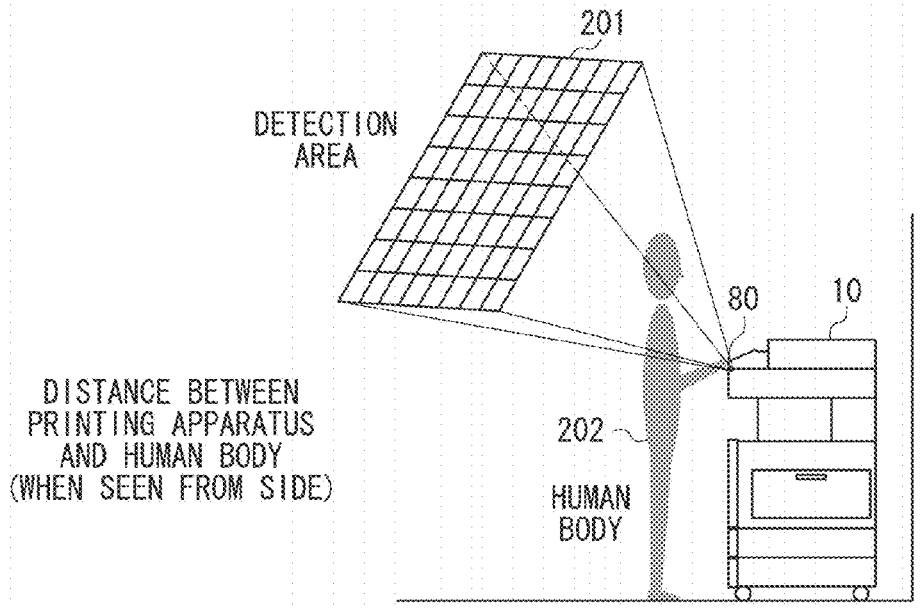
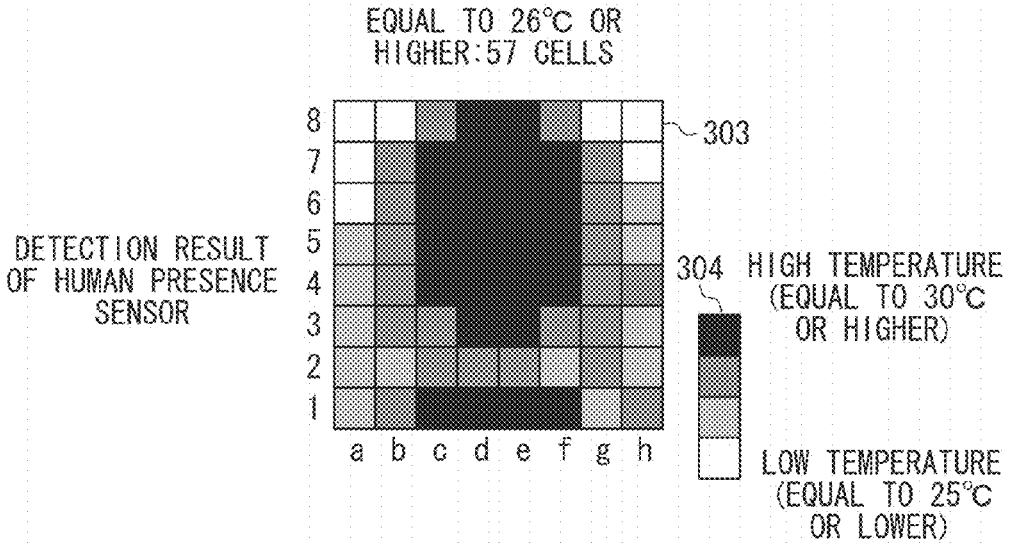

APPROACHING FROM FRONT

APPROACHING FROM RIGHT

STATE DURING OPERATION OF PRINTING APPARATUS

MAIN AREA AND REFERENCE POINT

16 REPRESENTATIVE POINTS

25 REPRESENTATIVE POINTS

36 REPRESENTATIVE POINTS

PATTERN OF PASSERBY CROSSING NEARBY

PATTERN OF PERSON APPROACHING FROM FRONT FOR PURPOSE OF USING PRINTING APPARATUS

FIG. 8

801

802

803

| AMBIENT TEMPERATURE (°C) | DETECTION TEMPERATURE (°C) | | | | |
|---|---|---|---|---|---|
| | T0 | T1 | T2 | T3 | T4 |
| ... | | | ... | | |
| 24 | | | ... | | |
| 25 | LESS THAN 27 | 27 | 28 | 30 | 31 |
| 26 | | | ... | | |
| 27 | | | ... | | |
| ... | | | ... | | |

804

| 805 INSTALLATION INFORMATION | 806 AREA M | 807 REFERENCE POINT | 808 DEFINITION OF T ZONE (°C) | 809 RECOVERY LEVEL | 810 RECOVERY CONTENT | 811 Timeout | 812 APPROACHING DEGREE INDEX (NUMBER OF TIMES) |
|---|---|---|---|---|---|---|---|
| (HEIGHT, ANGLE) | (Xm1, Ym1) (Xm2, Ym2) | (Xo, Yo) | 27<T0 (2.0m≦T0) | Step0 | SLEEP CONTINUATION | - | Rmax |
| | | | 27≦T1<28 (2.0m>T1≧1.5m) | Step1 | UI ACTIVATION PREPARATION | TimeOut1 | |
| | | | 28≦T2<30 (1.5m>T1≧1.0m) | Step2 | DISPLAY ONLY UI SCREEN | TimeOut2 | |
| | | | 30≦T3<31 (1.0m>T1≧0.5m) | Step3 | CONTROLLER ACTIVATION | TimeOut3 | |
| | | | 31≦T4 (0.5m>T1) | Step4 | KEY INPUT TO UI UNIT POSSIBLE | TimeOut4 | |

| |
|---|
| FIG. 10A |
| FIG. 10B |

PRINTING APPARATUS, METHOD FOR CONTROLLING PRINTING APPARATUS, AND RECORDING MEDIUM

BACKGROUND

1. Field

Aspects of the present invention generally relate to a printing apparatus, a method for controlling the same, and a recording medium.

2. Description of the Related Art

A recent printing apparatus typically has a power-saving mode function for reducing standby power. When the printing apparatus is not used in its activated state for a certain period of time, the printing apparatus is automatically shifted from a normal mode capable of immediately dealing with print processing to an energy-saving mode to reduce power on standby. However, from a viewpoint of a user who uses the printing apparatus, convenience may be lost due to a pressing action of a power-saving key included in the printing apparatus to recover from the power-saving mode to the normal mode or waiting time until the recovery to the normal mode.

In order to solve the issue, in recent years, there has been offered a method for mounting a human presence sensor on the printing apparatus to detect a person and automatically recovering the printing apparatus from the energy-saving mode to the normal mode when the user approaches the apparatus (e.g., refer to Japanese Patent Application Laid-Open No. 2012-177796).

According to the method discussed in Japanese Patent Application Laid-Open No. 2012-177796, the automatic recovering from the energy-saving mode is carried out by using two types of human presence sensors, namely, a pyroelectric sensor and a reflection sensor. The pyroelectric sensor is a sensor for detecting a change in amount of infrared rays emitted from a heat source (person or the like). Using the pyroelectric sensor enables capturing of a heat source (heat radiated from person) located relatively far and approaching an image forming apparatus.

The reflection sensor is a sensor for emitting "light" such as visible rays or infrared rays as signal light from a light projection unit and detecting, by a light reception unit, light reflected from a detected object or a change in the amount of blocked light, to detect presence or absence of the object. A detection distance is generally short.

According to the method discussed in Japanese Patent Application Laid-Open No. 2012-177796, the heat source is captured at a distance of about 1 to 2 m from the printing apparatus by the pyroelectric sensor and, when the reflection sensor detects that the heat source reaches a position very close to the printing apparatus, the recovering from the energy-saving mode is started.

Thus, according to the technique discussed in Japanese Patent Application Laid-Open No. 2012-177796, the printing apparatus can be automatically recovered from the energy-saving mode to the normal mode without erroneously detecting the person.

The use of the technique discussed in Japanese Patent Application Laid-Open No. 2012-177796 can solve the first issue of the power-saving mode. Specifically, the user can be relieved of the cumbersome and complicated action of manually recovering from the power-saving mode such as pressing of the power-saving key. However, the technique cannot provide a satisfactory solution to the second issue, namely, the waiting time until the recovery to the normal mode, since the recovering is performed when the heat source (person) reaches a position close to the printing apparatus.

In recent years, as another human presence sensor, an infrared array sensor has begun to be widely used. The infrared array sensor is a sensor capable of estimating a moving direction of a heat source or a distance to the heat source by arranging infrared sensors for detecting a change in amount of infrared rays in an array.

SUMMARY

Aspects of the present invention are generally directed to a printing apparatus, a method for controlling the same, and a recording medium capable of executing power-saving control according to a change of a moving direction of a heat source approaching or passing by the printing apparatus.

According to an aspect of the present invention, a printing apparatus capable of shifting a power state to a second power state where power consumption is lower than a first power state, includes a detection unit configured to detect a heat source approaching the printing apparatus in an area divided into a predetermined number of areas for each passage of a predetermined period of time, a first calculation unit configured to calculate an average temperature of respective areas including representative points specified from the predetermined number of divided areas detected by the detection unit, a specifying unit configured to specify a current position of the heat source based on the average temperature of the respective areas calculated by the first calculation unit, a second calculation unit configured to calculate a distance between the current position specified by the specifying unit and a predetermined reference point, a first determination unit configured to determine whether the heat source is moving to pass by the printing apparatus based on a change of the current position specified by the specifying unit, a second determination unit configured to determine whether the heat source is approaching the printing apparatus based on a change of the distance calculated by the second calculation unit, and a power control unit configured to shift, in a case where the second determination unit determines that the heat source is approaching the printing apparatus, the power state of the printing apparatus from the second power state to the first power state step by step according to the distance calculated by the second calculation unit.

Further features of the present disclosure will become apparent from the following description of exemplary embodiments with reference to the attached drawings.

BRIEF DESCRIPTION OF THE DRAWINGS

FIGS. 3A to 3C are diagrams each illustrating a detection pattern of a heat source approaching a detection area of the human presence sensor.

FIG. 8 is a table illustrating parameters referred to during the human body detection processing.

DESCRIPTION OF THE EMBODIMENTS

Hereinafter, exemplary embodiments will be described in detail with reference to the drawings.

<System Configuration>

Figure 1:
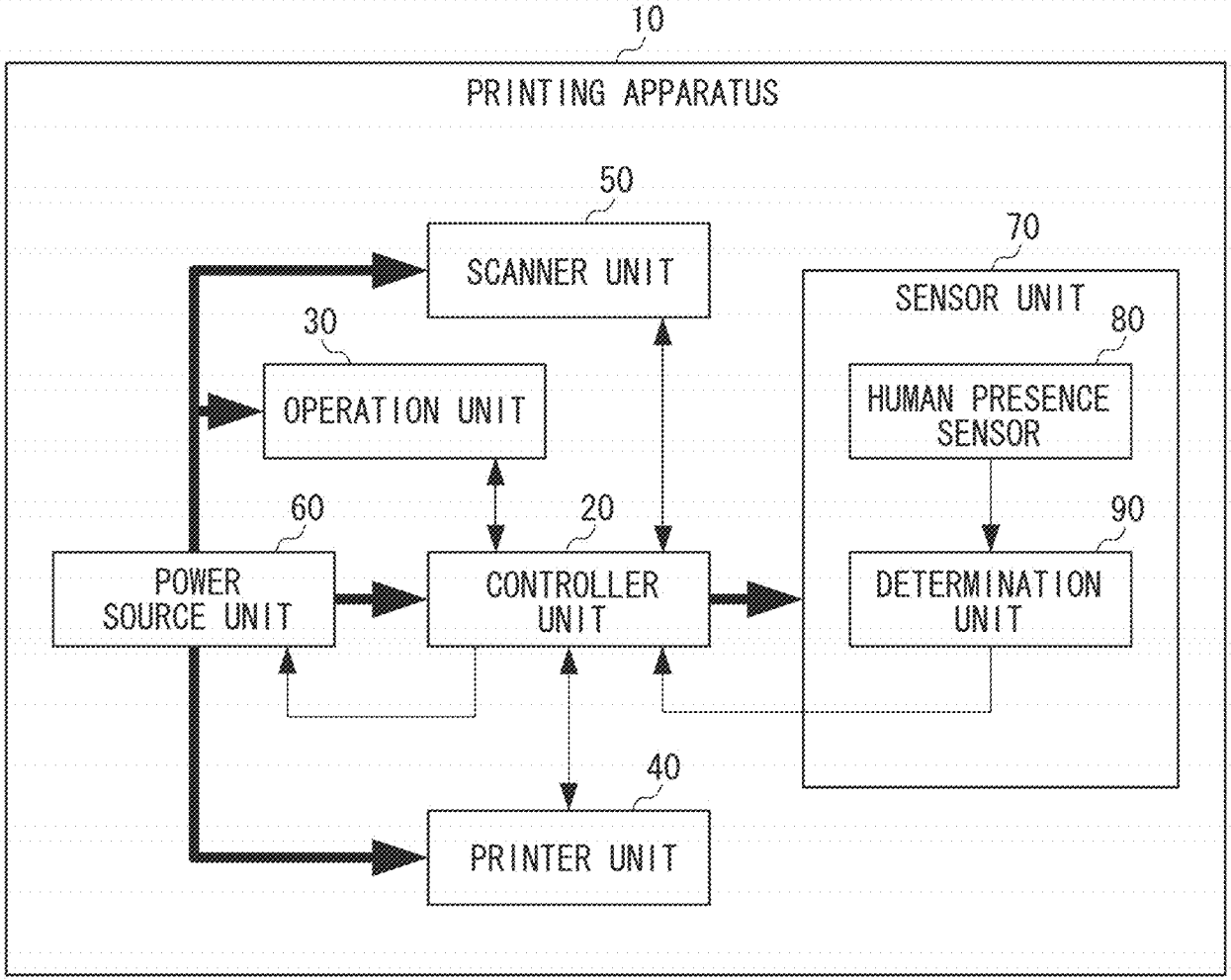
FIG. 1 is a block diagram illustrating a configuration of a printing apparatus.

FIG. 1 is a block diagram illustrating a configuration of a printing apparatus according to a first exemplary embodiment. The printing apparatus according to the present exemplary embodiment performs power control for shifting a power state to a second power state where power consumption is lower than a first power state. The first power state corresponds to a power state where power is supplied from a power source unit described below to each unit, in a state in which print processing can be executed. The second power state corresponds to a power state where power supply to a controller unit or an engine unit described below for controlling the print processing is stopped.

In a printing apparatus 10 illustrated in FIG. 1, a controller unit 20 executes print data generation, input/output control, and power control of the entire apparatus. An operation unit 30 can set various printing conditions and check a print status. A printer unit 40 prints the print data transmitted from the controller unit 20 on a sheet. A scanner unit 50 reads paper information to convert it into electronic data. Copy processing can be carried out by the controller unit 20 processing the electronic data and by the printer unit 40 printing the data on the sheet. The power source unit 60 supplies required power to each unit of the printing apparatus 10.

Though not illustrated, the controller unit 20 and a sensor unit 70 are separated into a first power system circuit to which power is always supplied and a second power system circuit capable of arbitrarily controlling ON/OFF of supply power. By the first power system circuit of the controller unit 20, a power-saving level of the entire printing apparatus 10 is controlled step by step through control of enable signals of the power source unit 60 and the power source circuit of each unit.

The sensor unit 70 includes a human presence sensor 80 and a determination unit 90. The human presence sensor 80 configured to detect biological heat radiated from an operator approaching to operate the printing apparatus as a heat source is a device for detecting presence or absence of a person around the printing apparatus 10. As the human presence sensor 80, a pyroelectric infrared sensor, an infrared array sensor, and a reflection sensor are available. In the present exemplary embodiment, the infrared array sensor is used as the human presence sensor 80. The determination unit 90 analyses a detection signal from the human presence sensor 80 and frame information generated in time series to check presence or absence of a person and determine a distance from the person to the printing apparatus 10 or a moving direction of the person. A result of the determination is transmitted to the controller unit 20. The human presence sensor 80 executes, for each passage of a certain period of time, processing of detecting a heat source approaching the printing apparatus corresponding to an area divided into a predetermined number of areas. The present exemplary embodiment will be further described in detail referring to the drawings.

Figure 2:
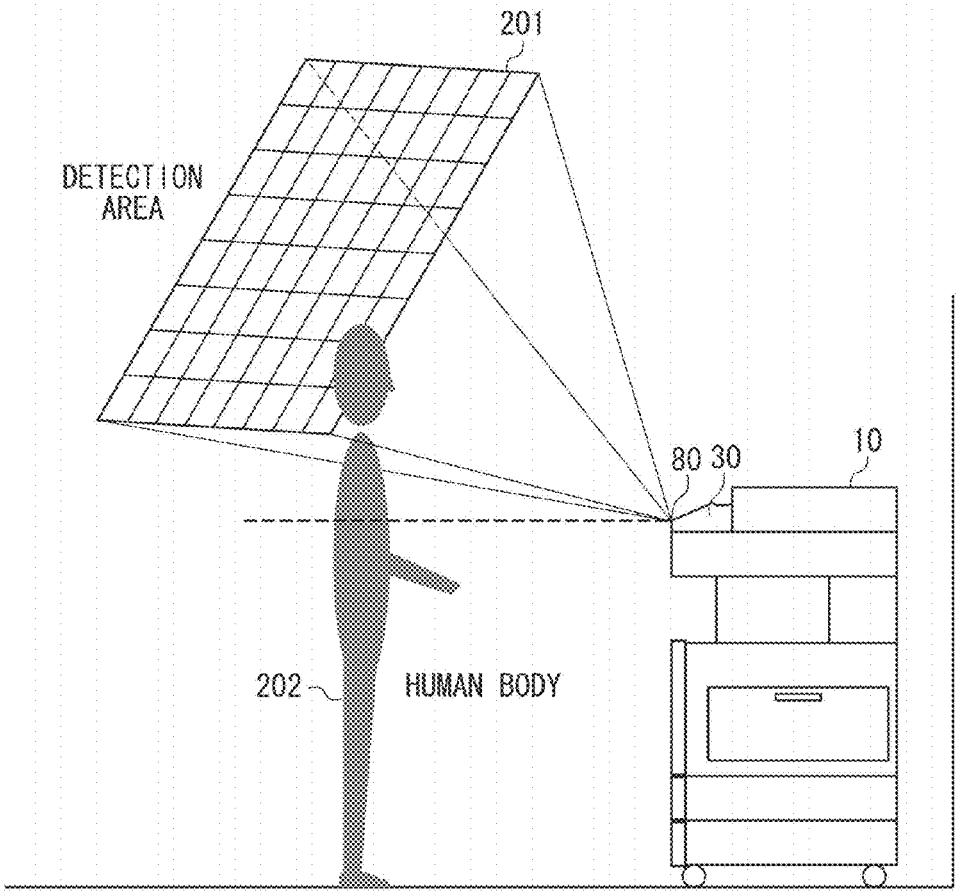
FIG. 2 is a diagram illustrating an installation example of a human presence sensor illustrated in FIG. 1.

FIG. 2 is a diagram illustrating an installation example of the human presence sensor 80 illustrated in FIG. 1.

As illustrated in FIG. 2, in the present exemplary embodiment, the infrared array sensor is used as the human presence sensor 80, and installed near the operation unit 30 of the printing apparatus 80. A detection area 201 is an area in which an approach of a human body 202 to a certain distance can be detected.

FIGS. 3A to 3C are diagrams each illustrating a detection pattern of the heat source approaching the detection area illustrated in FIG. 2. The detection pattern corresponds to a temperature distribution pattern when the human body as the heat source approaches to be orthogonal to a center of a detection area plane.

In each of FIGS. 3A to 3C, the human presence sensor 80, which is an infrared array sensor including a plurality (e.g., 8×8) of detection areas, is used, and an example of a frame (temperature distribution) output from the human presence sensor 80 when the human body 202 approaches the printing apparatus 10 from front is illustrated.

A frame 301 illustrated in FIG. 3A represents a temperature distribution when the human body 202 as the heat source is captured from a farthest detectable distance from the printing apparatus 10. In each cell of the frame 301, a temperature detected by one of the infrared sensors is given.

As indicated by a temperature display level 304, a white cell represents a temperature equal to 25° C. or lower, a black cell represents a temperature equal to 30° C. or higher, and an intermediate cell represents a temperature equal to 26° C. or higher and lower than 30° C. The frame 301 includes 4 cells representing a temperature equal to 26° C. or higher.

A frame 302 illustrated in FIG. 3B represents a temperature distribution in a case of several frames advanced from the frame 301, in other words, the human body 202 has further approached the printing apparatus 10. The frame 302 includes 21 cells representing a temperature equal to 26° C. or higher.

A frame 303 illustrated in FIG. 3C represents a temperature distribution when the human body 202 stands before the printing apparatus 10 and uses the apparatus. The frame 303 includes 57 cells representing a temperature equal to 26° C. or higher.

As can be understood from the temperature distributions of the frames respectively illustrated in FIGS. 3A to 3C, as the human body 202 approaches the printing apparatus 10, more high-temperature cells (26° C. or higher in the present exemplary embodiment) are included in the frames. This indicates that by analyzing a series of in-frame temperature distributions, an approaching direction and a distance of the human body 202 to the printing apparatus 10 can be estimated.

A relationship between the temperature distribution of the infrared array sensor and the distance of the human body 202 to the printing apparatus 10 may be changed depending on various conditions, and can be estimated from data measured by experiment.

Figure 4A:
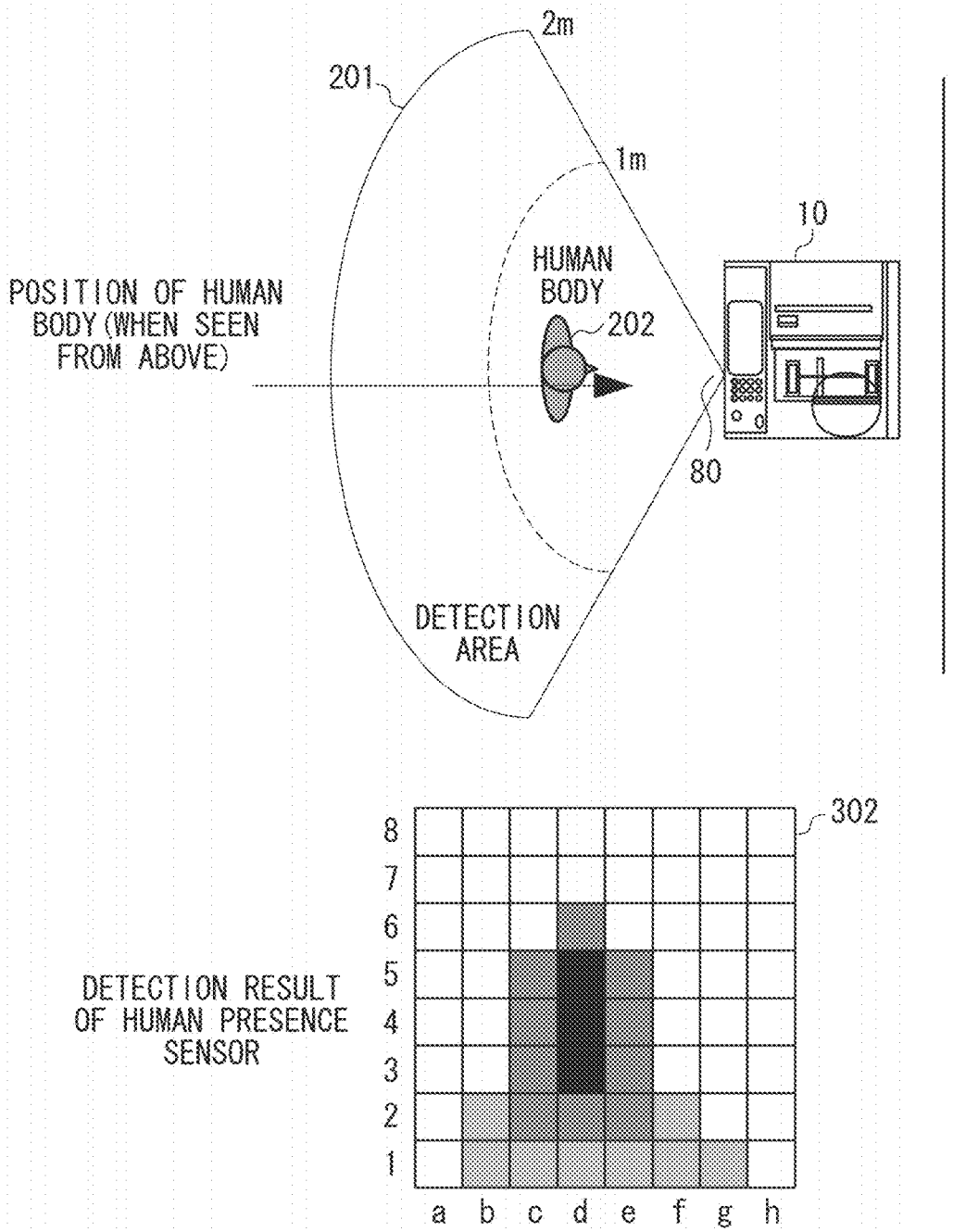
FIGS. 4A to 4C are diagrams each illustrating a detection pattern of the heat source approaching the detection area of the human presence sensor.
Figure 4B:
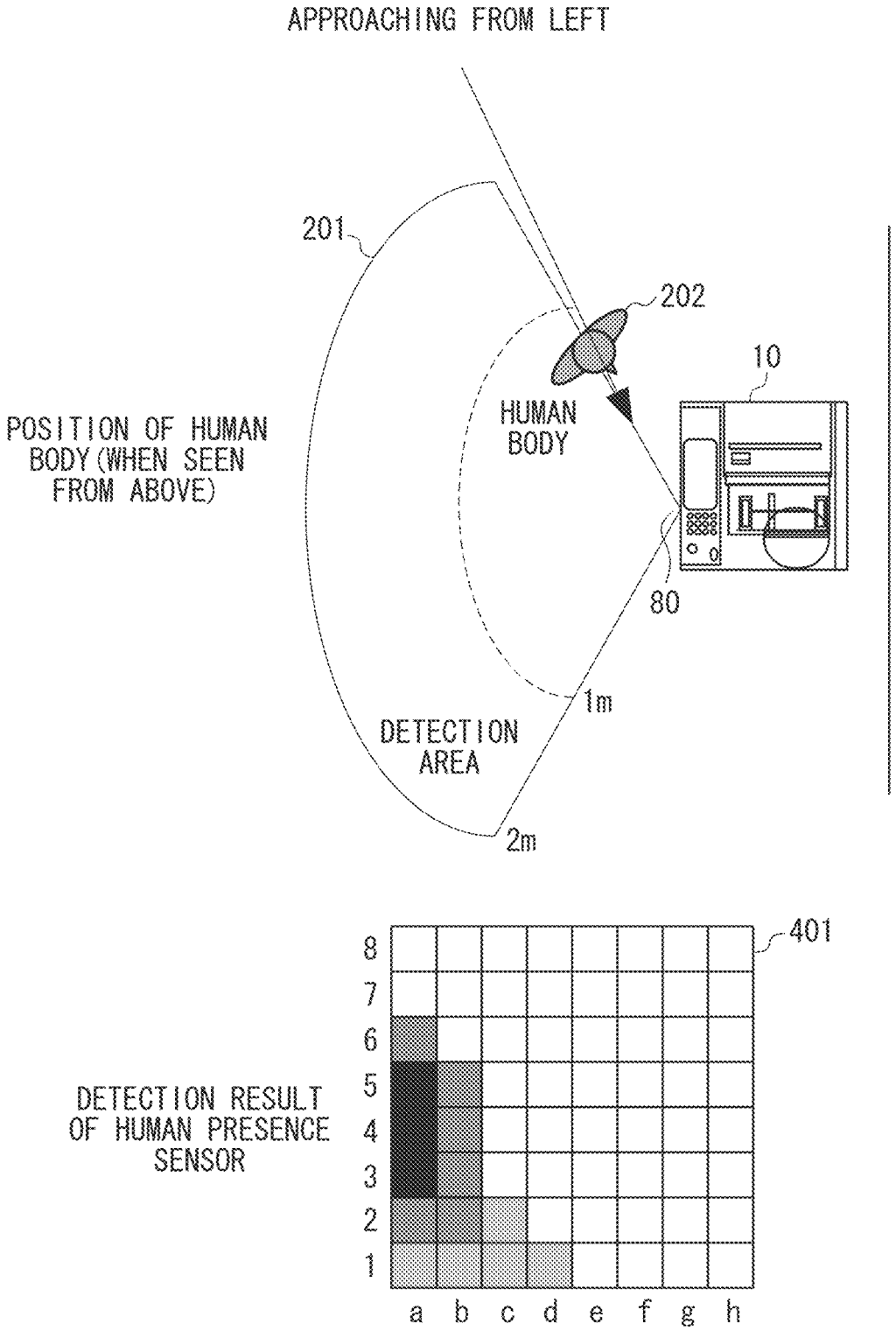
Figure 4C:
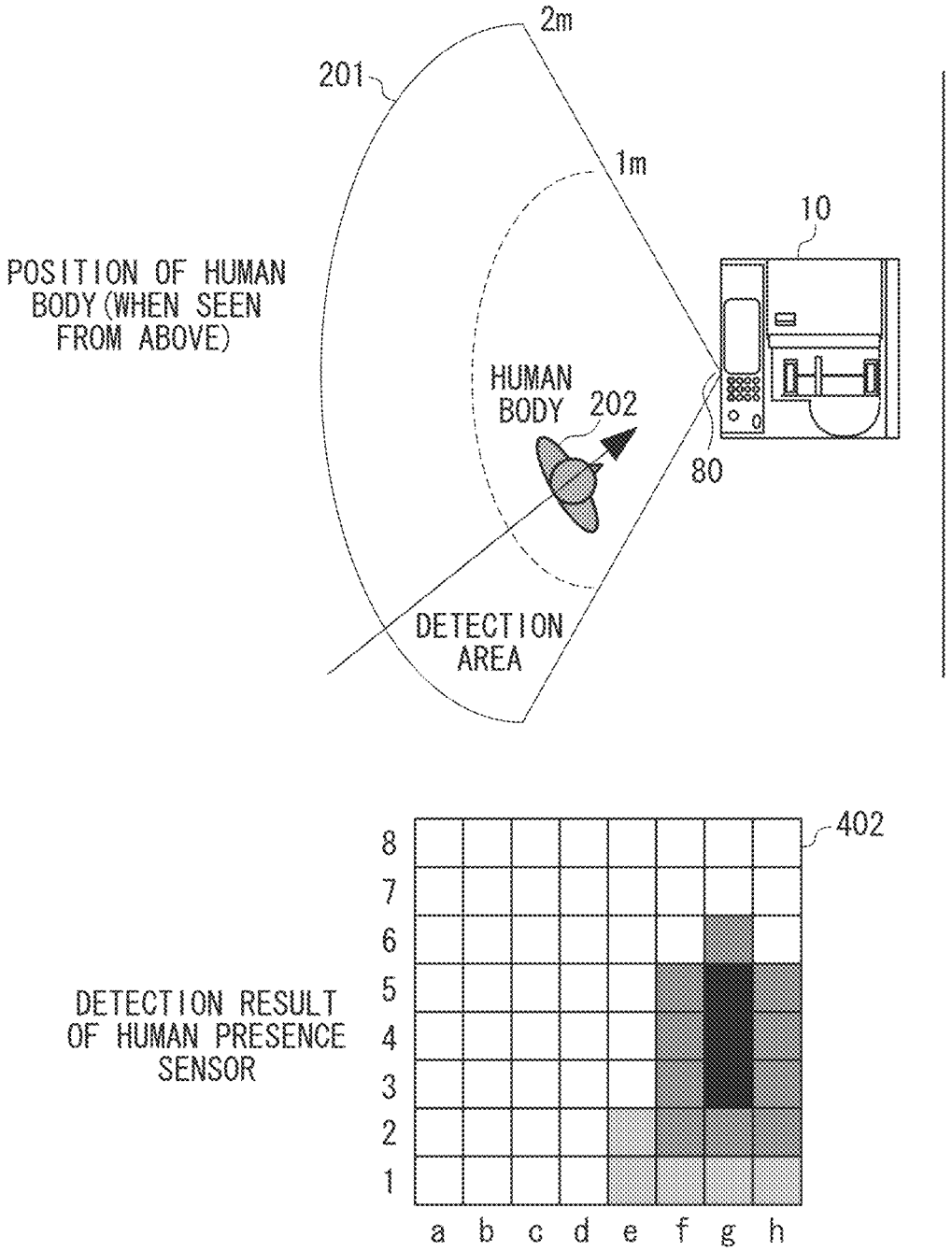

FIGS. 4A to 4C are diagrams each illustrating a detection pattern of the heat source approaching the detection area illustrated in FIG. 2. The detection pattern corresponds to a temperature distribution pattern when the human body as the heat source approaches with a predetermined angle to the center of the detection area plane.

Hereinafter, examples of frames captured by the human presence sensor 80 based on approaching directions of the human body 202 to the printing apparatus 10 will be described.

A frame 302 illustrated in FIG. 4A corresponds to an example of approaching from the front side, a frame 401 illustrated in FIG. 4B corresponds to an example of approaching from the left side, and a frame 402 illustrated in FIG. 4C corresponds to an example of approaching from the right side. As can be estimated from FIGS. 4A to 4C, by analyzing temperature distributions of the frames capturing the human body 202 as the heat source approaching from the left side, right side, or the center to calculate a moving direction, whether the human body 202 has been approaching the printing apparatus 10 can be determined.

Next, a method for analyzing the series of in-frame temperature distributions to estimate the distance and the moving direction of the heat source with respect to the printing apparatus 10 will be described.

Figure 5A:
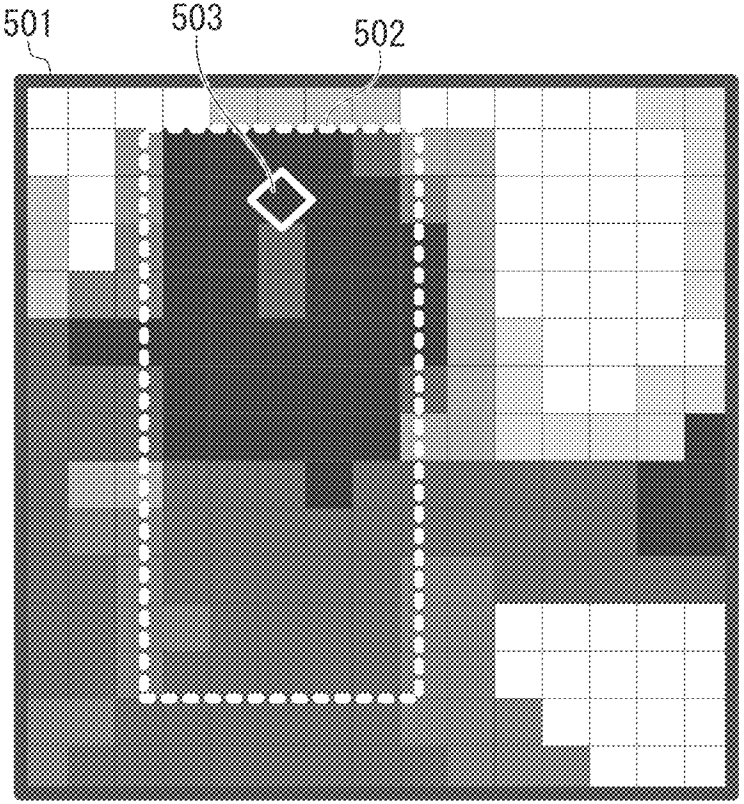
FIGS. 5A and 5B are diagrams each illustrating human body detection processing executed by the human presence sensor.
Figure 5B:
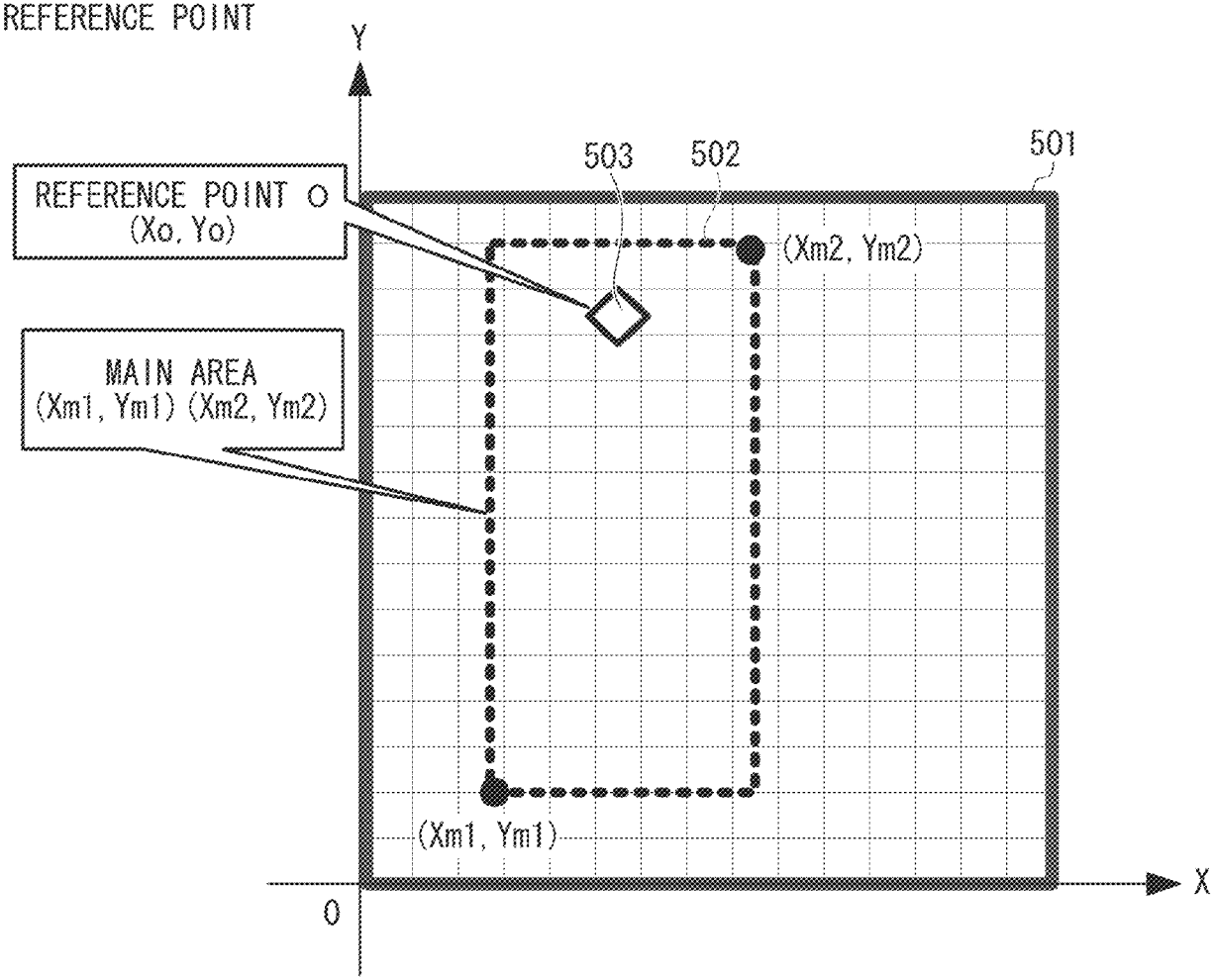

FIGS. 5A and 5B are diagrams each illustrating an average standing position area of the human body 202 and a characteristic point therein based on frame information about the human body 202 operating the printing apparatus 10, captured by the human presence sensor 80.

FIG. 5A illustrates an example of an in-frame temperature distribution when the human body 202 operates the printing apparatus 10 in a case where the infrared array sensor is installed at a desired position and in a desired direction of the printing apparatus 10.

In FIG. 5A, a frame 501 represents a temperature distribution with a resolution of 15×15 cells. A main area 502 in the frame 501 indicates an average standing position area of the human body 202 obtained from a large number of measurement results. A reference point 503 in the main area 502 is a characteristic point when the human body 202 stands in front of the printing apparatus 10. For example, a part of a face of the human body 202 that has approached the apparatus, which is a high-temperature portion, is a representative example of the reference point 503.

FIG. 5B illustrates the main area 502 and the reference point 503 on an XY plane where a left lower part of the frame 501 is an original point. In the example illustrated in FIG. 5B, the main area 502 on the XY plane is represented by a rectangular area of diagonal points (Xm1, Ym1) and (Xm2, Ym2). A reference point O in the main area 502 is indicated by coordinates (Xo, Yo).

In FIGS. 5A and 5B, the main area 502 is represented by the rectangular area formed by the diagonal points. Generally, however, the main area 502 may be an area of an arbitrary shape. The reference point O 503 may also be an arbitrary coordinate point in the main area 502.

The main area 502 and the reference point O 503 therein are affected by an installation position, a height or an angle of the human presence sensor 80 with respect to the printing apparatus 10 described above referring to FIG. 2.

Figure 6A:
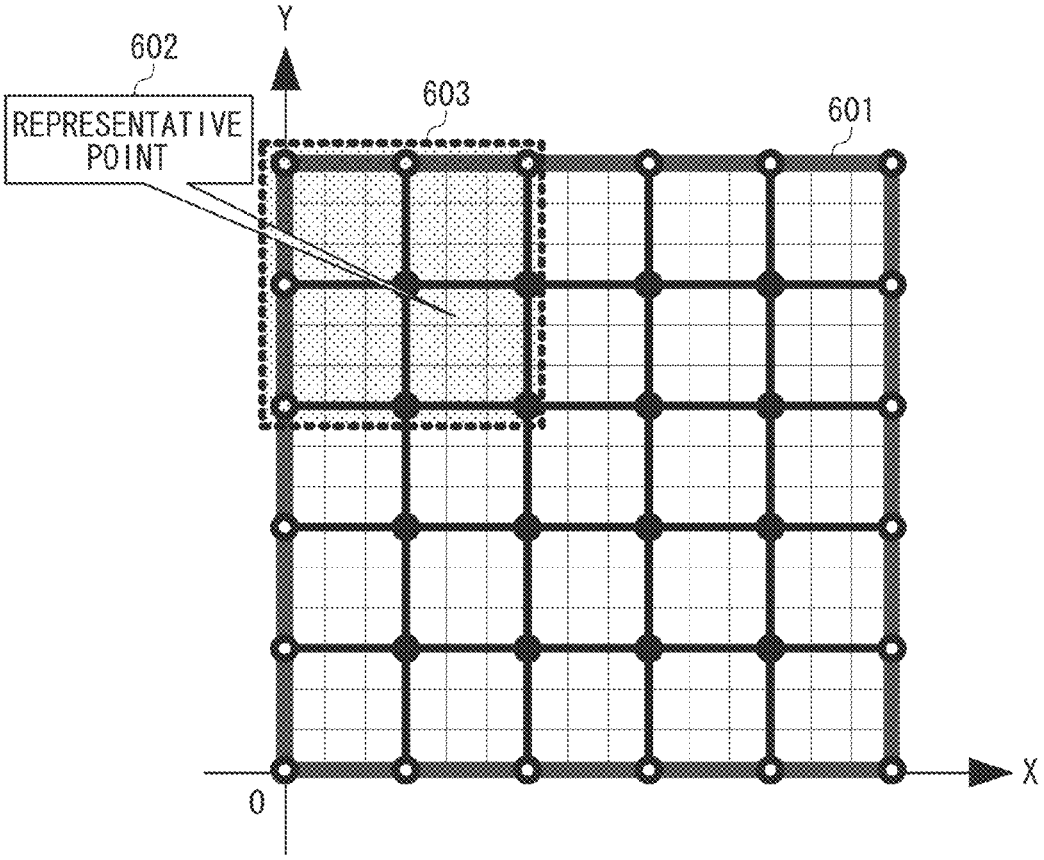
FIGS. 6A to 6C are diagrams each illustrating the human body detection processing executed by the human presence sensor.
Figure 6B:
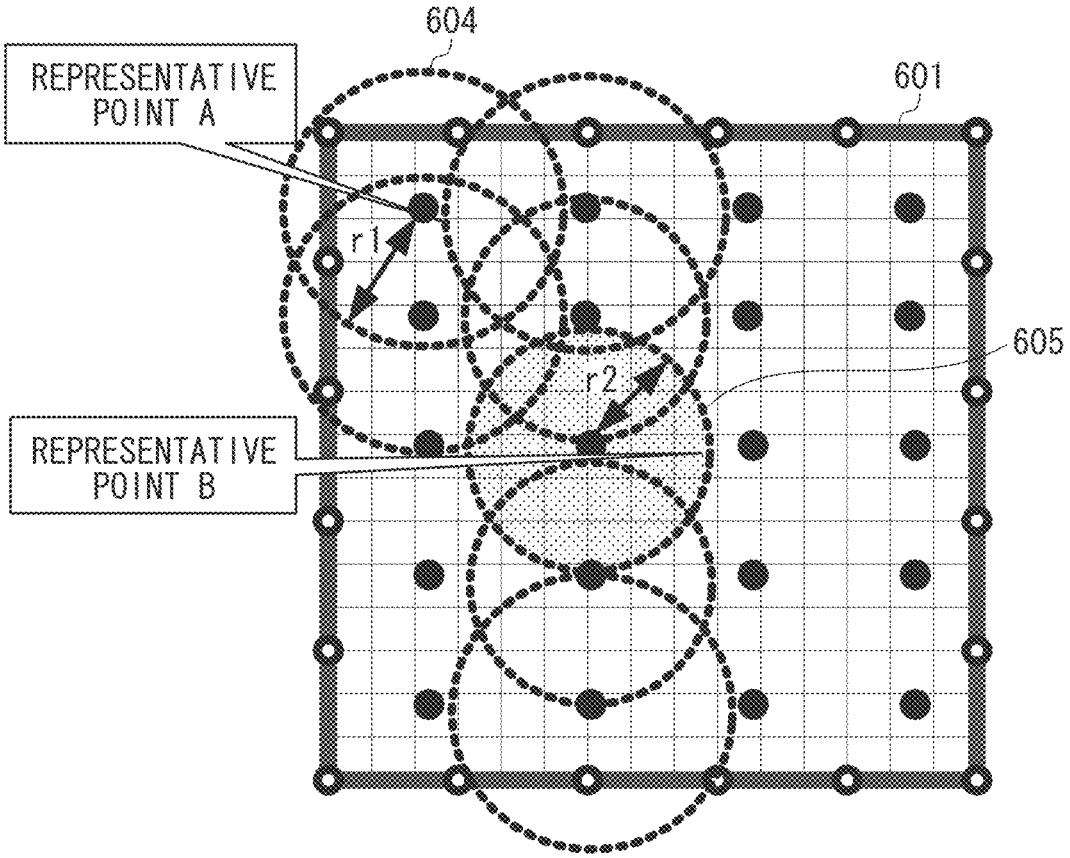
Figure 6C:
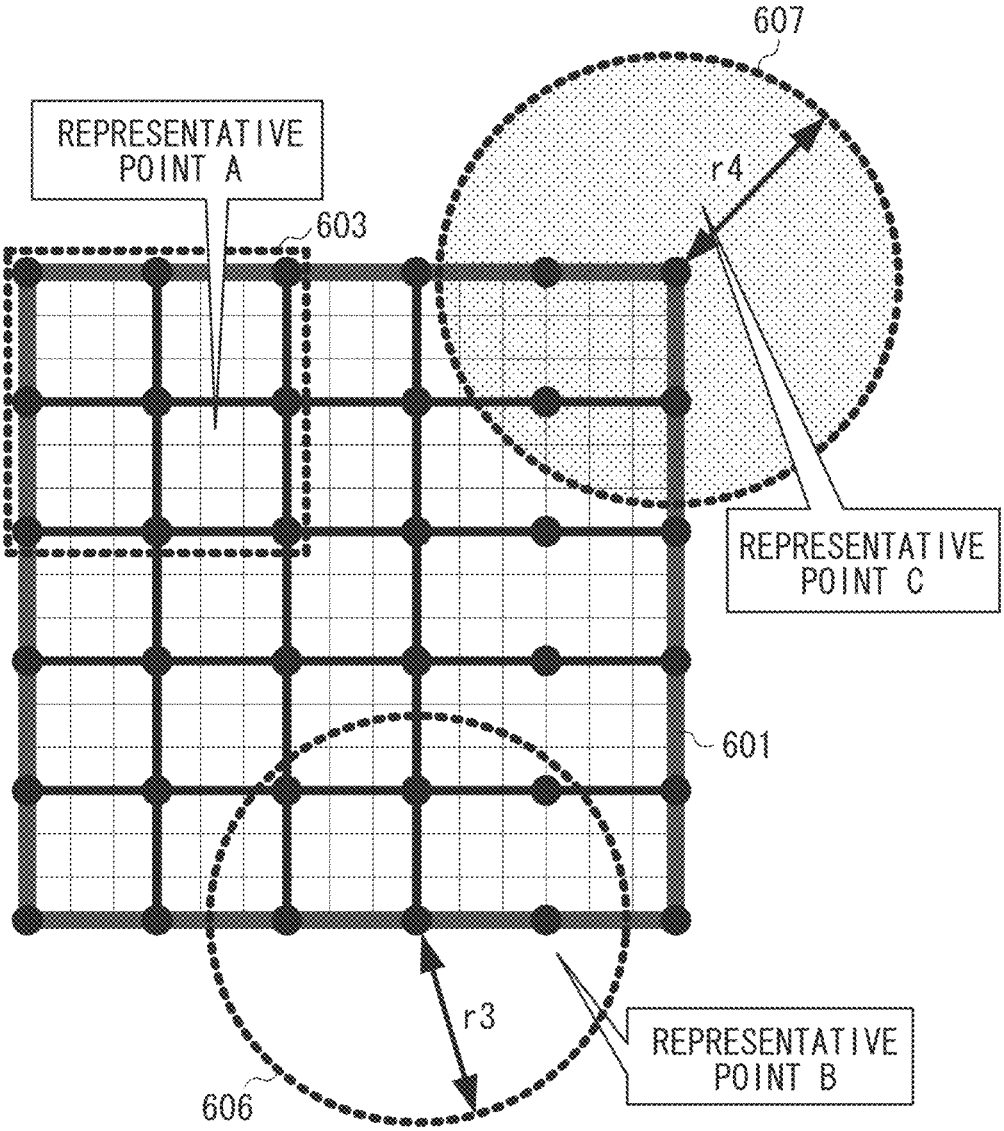

FIGS. 6A to 6C are diagrams each illustrating a method for obtaining an uneven in-frame temperature distribution using the human presence sensor 80 illustrated in FIG. 1.

Each of 16 black points in a frame 601 illustrated in FIG. 6A is a representative point 602. A representative point 602 is a center point of a rectangular area 603 having 6×6=36 cells. The determination unit adds temperatures of the 36 cells included in the rectangular area 603, and an average temperature thereof is given as attribute information of the representative point 602. An area including a representative point having a high average temperature can be understood to be a current position of the heat source. The current position can be specified based on a change where the heat source passes by the printing apparatus 10 as time elapses or a change where the heat source gradually approaches to operate the printing apparatus 10. FIGS. 6B and 6C illustrates other examples of determining representative points 602.

FIG. 6B illustrates an example where a frame 601 includes 20 representative points 602 (black points). Among the 20 representative points 602, surrounding 14 points are determined as center points of circular areas 604 of radiuses r1, and internal 6 points are determined as center points of circular areas 605 of radiuses r2. An average temperature of cells contacting the insides of the two types of circular areas is given as attribute information of each representative point 602.

FIG. 6C illustrates an example where a frame 601 includes 36 representative points 602. Among the 36 representative points 602, inner side 16 points are determined as center points of rectangular areas 603 having 6×6 cells, surrounding 12 points excluding those at 4 corners are determined as center points of circular areas 606 of radiuses r3, and 4 points at the 4 corners are determined as center points of circular areas 607 of radiuses r4. An average temperature of cells included or contacting the rectangular areas 603 and the two types of circular areas 606 and 607 is given as attribute information of each representative point 602.

Thus, the number of representative points 602 included in the frame 601 may be arbitrarily determined in general, and an area for determining the representative point 602 may have an arbitrary shape. Positions of the representative points 602 may be at arbitrary coordinate positions as long as they are in the areas 603 to 607.

Figure 7A:
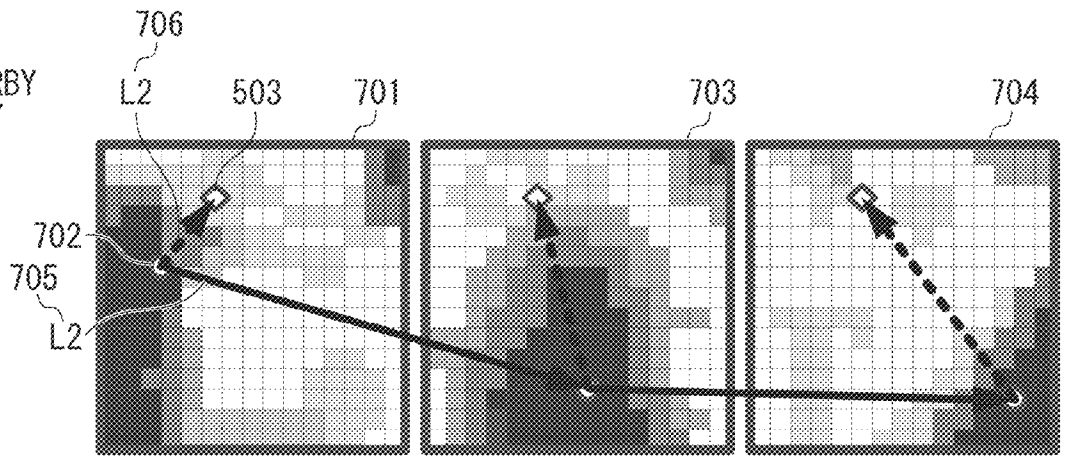
FIGS. 7A and 7B are diagrams each illustrating the human body detection processing executed by the human presence sensor.
Figure 7B:
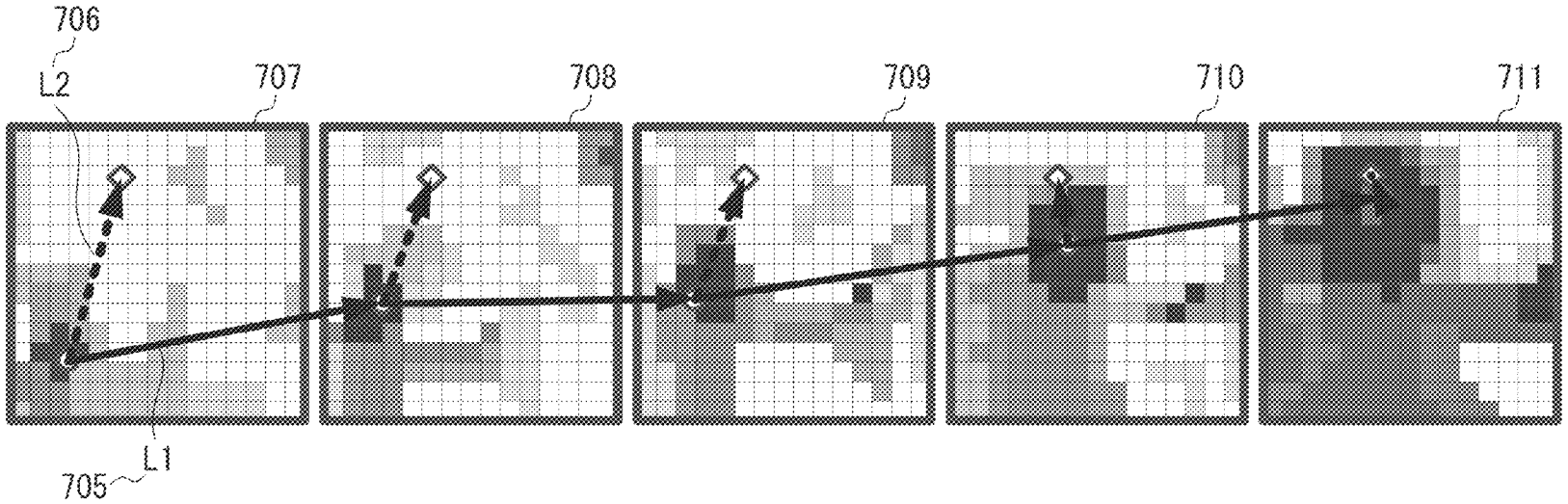

FIGS. 7A and 7B are diagrams each illustrating a method for calculating movements of the human body 202 illustrated in FIG. 1 in a horizontal direction and a depth direction. More specifically, the present exemplary embodiment is an example illustrating the method for calculating the movements of the human body 202 in the horizontal direction and the depth direction by using the reference point 503 described above referring to FIGS. 5A and 5B and the representative point 602 described above referring to FIGS. 6A to 6C. Three frames 701, 703, and 704 illustrated in FIG. 7A indicate temperature distribution patterns of a passerby crossing near the printing apparatus 10.

A representative point Xfn 702 in the frame 701 illustrated in FIG. 7A is set by, for example, determining one of the 16 representative points illustrated in FIG. 6A as a frame representative point. Arbitrary algorithm may be employed for determining the frame representative point Xfn 702. In the present exemplary embodiment, among the 16 representative points, one representative point that has a highest average temperature and is closest to the reference point O is set as a frame representative point in current frames.

By calculating an amount of change in coordinates L1 (705) of the frame representative point among the continuous frames 701, 703, and 704 illustrated in FIG. 7A, the movement of the heat source (human body 202) in the horizontal direction can be detected. In the example of FIG. 7A (solid-line arrow), it is determined that the human body 202 passes by near the printing apparatus 10 from right to left, based on a changing direction of the L1 (705).

Then, by calculating a distance L2 (706) between the reference point O 503 and the frame representative point 702, the movement of the heat source (human body 202) in the depth direction can be detected. In the continuous frames 701, 703, and 704 illustrated in FIG. 7A, it is determined based on an amount of change in the distance L2 (706) that the human body 202 moves away from the printing apparatus 10 (broken-line arrow). Eventually, by combining the detection results of the movements of the human body in the horizontal direction and the depth direction in the continuous frames 701, 703, and 704 illustrated in FIG. 7A, it is determined that the human body 202 as the heat source is just a passerby passing by the printing apparatus 10.

Five frames 707 to 711 illustrated in FIG. 7B represent temperature distribution patterns of a person approaching the printing apparatus 10 almost from the front side for the purpose of using the apparatus. As in the case of the analysis described above referring to FIG. 7A, a changing direction of the L1 (705) for detecting a movement of a heat source in a horizontal direction and an amount of change in the L2 (706) for detecting a movement of the heat source in a depth direction are calculated based on the continuous frames 707 to 711 illustrated in FIG. 7B. The changing direction of L1 (705) indicates that movement of the heat source with respect to the reference point O 503 is from right to left, and the amount of change in L2 (706) indicates that the person approaches the reference point O. Thus, in the case illustrated in FIG. 7B, it is determined that the human body 202 as the heat source approaches the printing apparatus 10 with the intension of using the apparatus.

FIG. 8 is a table illustrating parameters referred to during the power-saving control in the printing apparatus according to the present exemplary embodiment. The example corresponds to various types of preset parameters necessary for executing processing for recovering of the printing apparatus 10 from or exiting of the printing apparatus 10 to the power-saving level based on the distance to the heat source estimated by the human presence sensor 80, and the horizontal direction detection unit and the depth direction detection unit. Hereinafter, the power-saving function or state will be referred to as sleep.

A table 801 illustrated in FIG. 8 indicates a relationship between a detection temperature T803 (T zone) with respect to an ambient temperature 802.

In the example illustrated in FIG. 8, there are 5 detection temperature zones T0 to T4. For example, in a case where an ambient temperature is 25° C. as illustrated in FIG. 8, the T zones are defined as T0 zone: lower than 27° C., T1 zone: 27° C., T2 zone: 28° C., T3 zone: 30° C., and T4 zone: equal to 31° C. or higher. The detection temperature corresponding to each T zone is associated with the average temperature of the frame representative point Xfn 702, and indicates a distance to the human body as the heat source.

A table 804 indicates various types of control parameters corresponding to the case where the ambient temperature 802 is 25° C. (indicated by an arrow). Installation information 805 is installation position information of the human presence sensor 80 with respect to the printing apparatus 10, and includes installation height and installation angle.

An area M806 and a reference point 807 indicate coordinate information of the diagonal points (Xm1, Ym1) and (Xm2, Ym2) for determining the rectangular area of the main area 502 described above referring to FIGS. 5A and 5B, and coordinate information of the reference point (Xo, Yo) included in the main area 502, respectively.

T zone definition 808 is a parameter indicating a relationship between the T zone 803 and a distance to the heat source. Distance definition of the T0 zone of lower than 27° C. is equal to 2.0 m or farther, distance definition of the T1 zone of equal to 27° C. or higher to lower than 28° C. is nearer than 2.0 m to equal to 1.5 m or farther, distance definition of the T2 zone of equal to 28° C. or higher to lower than 30° C. is nearer than 1.5 m to equal to 1.0 m or farther, distance definition of the T3 zone of equal to 30° C. or higher to lower than 31° C. is nearer than 1.0 m to equal to 0.5 m or farther, and distance definition of the T4 zone of equal to 31° C. or higher is nearer than 0.5 m.

A recovery level 809 indicates a level (Step 0 to 4) of recovering from (or exiting to) the sleep corresponding to the T zone definition 808. A recovery content 810 defines a state thereof. In this example, the state is defined as Step 0: continuation of the sleep, Step 1: activation preparation of the operation unit 30 (activation preparation of user interface), Step 2: only screen displaying of the operation unit 30, Step 3: activation of the controller unit 20, and Step 4: a state in which a key input to the operation unit 30 is possible.

Though not illustrated, the operation unit 30 includes a liquid crystal display (LCD) screen, a central processing unit (CPU) for executing screen displaying and processing of a key input from a button or a touch panel, and a storage unit.

The activation preparation of the operation unit 30 in the Step 1 indicates a state where the CPU is in activation processing, the screen displaying of the operation unit 30 in the Step 2 indicates a state where activation screen data prestored in the storage unit is only displayed on the LCD screen and a key input operation is not possible, the activation of the controller unit 20 in the Step 3 indicates recovering from a partially activated state to a completely activated state, and a state in which the key input to the operation unit 30 is possible in the Step 4 indicates a state where the operation unit 30 and the controller unit 20 are completely activated, key input information from the user is stored in the controller unit 20 by the operation unit 30, and a processing content when the printing apparatus 10 subsequently recovers to a printable state can be reserved. The Steps 0 to 4 also correspond to levels (changing levels) of states where the operator approaching the printing apparatus 10 is specified based on a temperature change detected by the human presence sensor 80 and a change occurs in an approaching distance to the printing apparatus 10 as illustrated in FIG. 8.

In this example, the T zone 803 is defined with the 5 steps (T0 to T4). Generally, however, the T zone is defined at arbitrary steps. The recovery level 809 and the recovery content 810 corresponding to the T zone 803 may also be defined arbitrarily.

Timeout 811 defines presence permission time of the heat source in the distance area defined by the T zone 803 or 808. An approaching degree index Rmax 812 is a parameter indicating an upper limit value of the number of times of determining negative as a result of determining whether the human body 202 as the heat source approaches the printing apparatus 10 based on the horizontal direction and the depth direction detection units between the frames described above referring to FIGS. 7A and 7B.

Figure 9A:
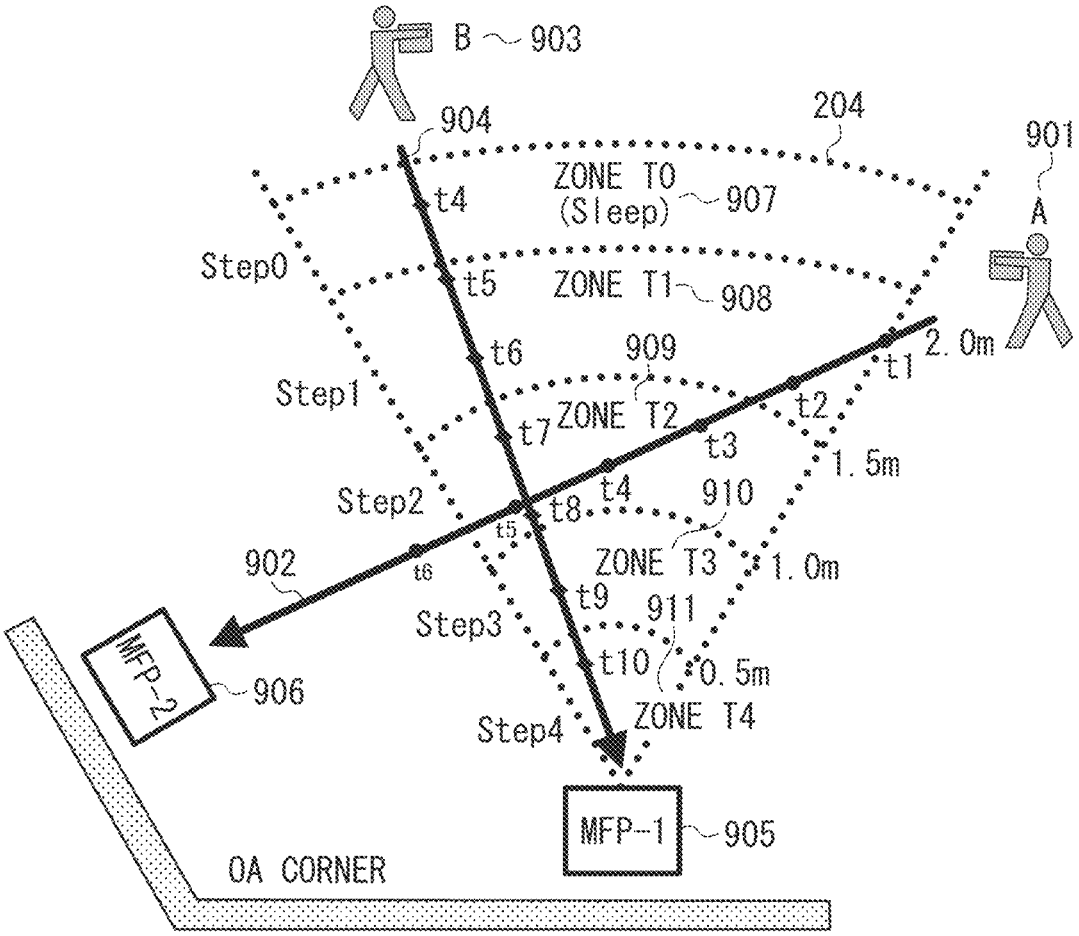
FIGS. 9A to 9C are diagrams each illustrating the human body detection processing executed by the human presence sensor.
Figure 9B:
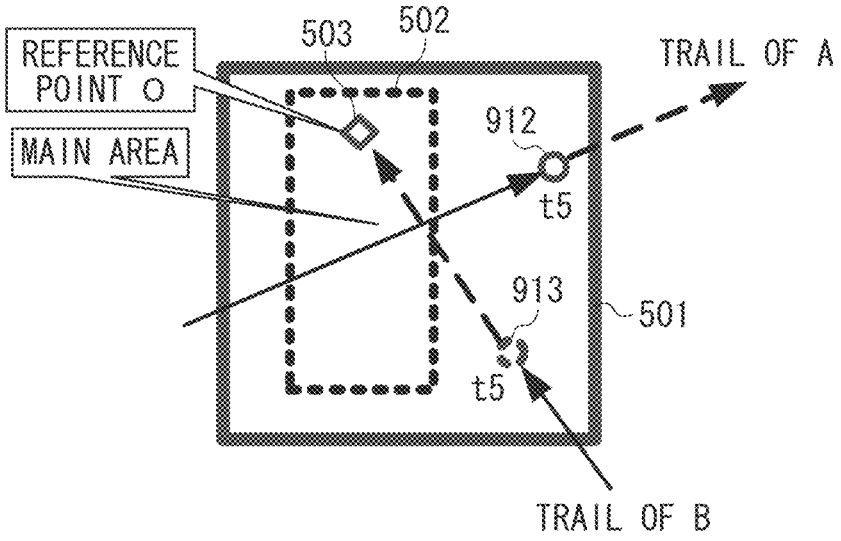
Figure 9C:
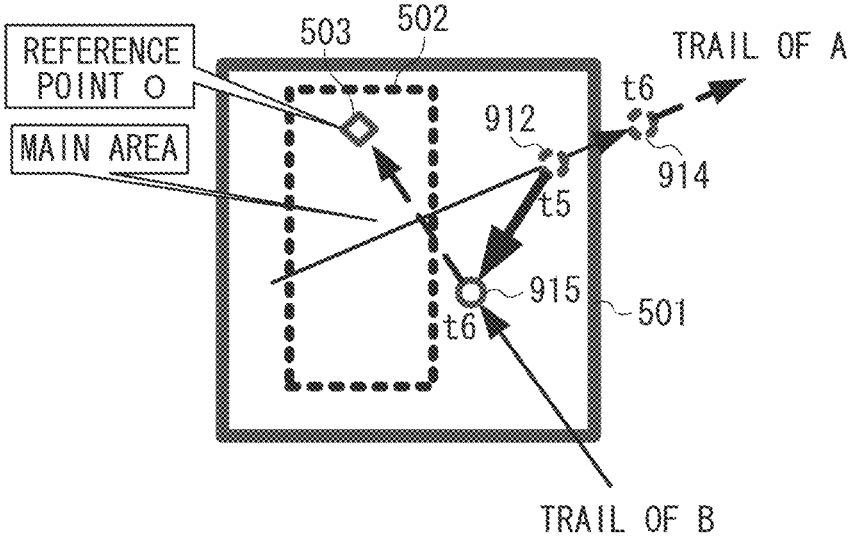

FIGS. 9A to 9C are diagrams each illustrating an example of processing for recovering from or exiting to sleep using the human presence sensor 80 illustrated in FIG. 1.

FIG. 9A illustrates a detection example of two persons at an office automation (OA) corner. A person A 901 approaches a multifunction peripheral (MFP)-2 906 installed at the OA corner to use it. A person B 903 approaches an MFP-1 905 to use it. An arrow 902 indicates a moving trail of the person A 905 at time t1 to t6, and an arrow 904 indicates a moving trail of the person B 903 at time t4 to t10. At each of the time t1 to t10, a frame is generated by the human presence sensor 80. In FIG. 9A, distances and directions to the heat sources (A 901 and B 903) in the detection area 201 indicated by broken lines are detected by the human presence sensor 80 installed at the MFP-1 905.

The T zone 803 (T0 to T4) illustrated in FIG. 9A, distances 0.5 m to 2.0 m corresponding to the T zone 803, and the recovery level 809 (Steps 0 to 4) with respect to recovering from (or exiting to) sleep have been described above referring to FIG. 8, and thus description thereof will be omitted.

Next, an outline of a processing flow for recovering from or exiting to sleep will be described in chronological order from the time t1 to t10.

Time t1: The person A 901 is detected. Tracking is started. The T0 zone 907 is continued.

Time t2: The person A 901 is determined to be a moving object. Processing for recovering from sleep is executed in Steps 0 to 1 of the T1 zone 908. Monitoring of presence time (Timeout 1) in the T1 zone 908 is started.

Time t3 to t5: Processing for recovering from sleep is executed in Steps 1 to 2 of the T2 zone 909. At time t3, monitoring of presence time (Timeout 2) in the T2 zone 909 is started. Meanwhile, the person A 901 is determined to be a passerby. A state at next time t6 is checked, and the processing exits to a predetermined step.

Time t6: Processing for exiting to sleep is executed in Step 2 to Step 1 of the T1 zone 908. Monitoring of presence time (Timeout 1) in the T1 zone 908 is started. In this case, although the person B 903 approaches the MFP-1 905 to use it at time t4, the person B 903 cannot be detected (ignored) until time t5 since the person A 901 of a high temperature exists before the person B 903.

Unless the person B 903 is present, the person A would have been out of the detection area 201 of the human presence sensor 80 at time t6, and thus exit processing would have been executed to a sleep state (i.e., Step 2 to Step 0). However, because of the presence of the person B 903, at time t5 to time t6, it is detected as if the heat source has moved from Step 2 to Step 1 (T2 zone 909 to T1 zone 908).

FIGS. 9B and 9C illustrate statuses at time t5 to time t6 based on a relationship between the reference point O 503 and the representative point 602. At the time t5, a representative point 912 of the person A 901 and a representative point 913 of the person B 903 are respectively at positions illustrated in FIG. 9B. At this time, since an average temperature of the reference point 912 of the person A 901 that is closer to the reference point O 503, the reference point 912 is selected as the frame representative point 702. In other words, the person B 903 is not detected at time t5. As the time passes from time t5 to time t6, as illustrated in FIG. 9C, the person A 901 moves out of the detection area 206 to a position 914, and a representative point 915 of the person B 903 is set as the frame representative point 702 at time t6. When seen from the human presence sensor 80, as indicated by an arrow from t5 to t6 illustrated in FIG. 9C, the frame representative point 702 is detected at a position away from the MFP-1 905. As a result, according to a detection distance of the frame representative point 915 at time t6, processing for exiting to sleep is executed from Step 2 to Step 1.

Time t7 to t8: The person B 903 approaches the T2 zone 909 and processing for recovering from sleep is executed from Step 1 to Step 2. Monitoring of presence time (Timeout 2) in the T2 zone 909 is started.

Time t9: The person B 903 further approaches the MFP-1 905, and processing for recovering from sleep is executed from Step 2 to Step 3. Monitoring of presence time (Timeout 3) in the T3 zone 910 is started.

Time t10: The person B 903 reaches a front standing position of the MFP-1 905, and a processing for recovering from sleep is executed from Step 3 to Step 5 of the T4 zone 911. Monitoring of presence time (Timeout 4) in the T4 zone 911 is started. The Timeouts 1 to 3 up to the T3 zone 910 corresponding to the time t1 to t9 indicate passage permission time in the corresponding T zones. When the permission time passes, processing for exiting to sleep is executed from current Step to Step 1. The Timeout 4 corresponding to the T4 zone 911 at the time t10 indicates permission time for the person B 903 from standing in front of the MFP-1 905 until starting some operation. Unless the person B 903 executes any operation to the MFP-1 905 within the permission time, processing for exiting from sleep is executed from Step 4 to Step 1. Needless to say, at all of the time t1 to t10, when the person A 901 or the person B 903 moves out of the detection area 201 and the heat source accordingly disappears, processing for exiting is executed from current Step to Step 0, in other words, to the original sleep state.

Figures 10, 10A:
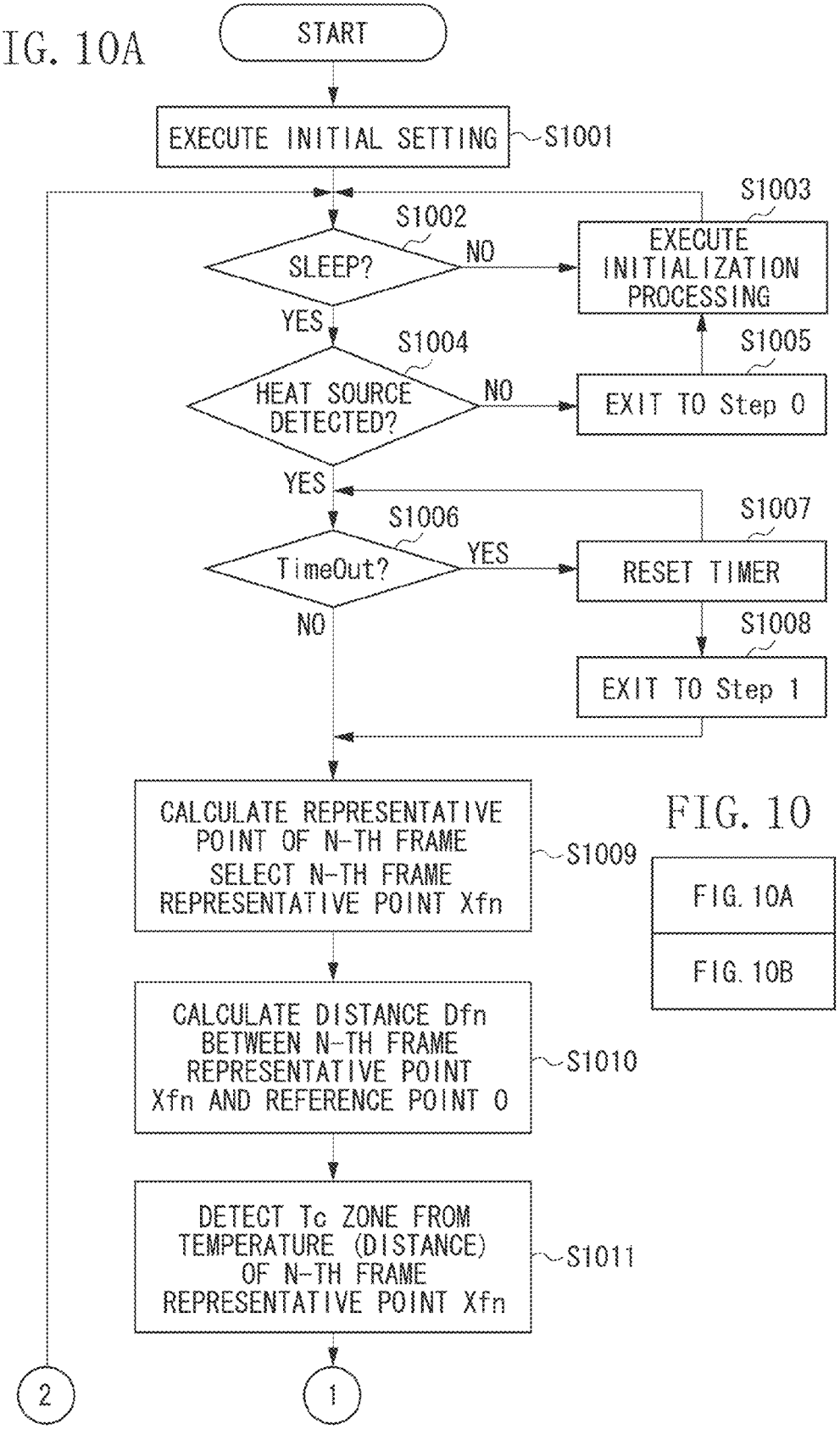
FIGS. 10 (A and B) is a flowchart illustrating a method for controlling the printing apparatus.
Figure 10B:
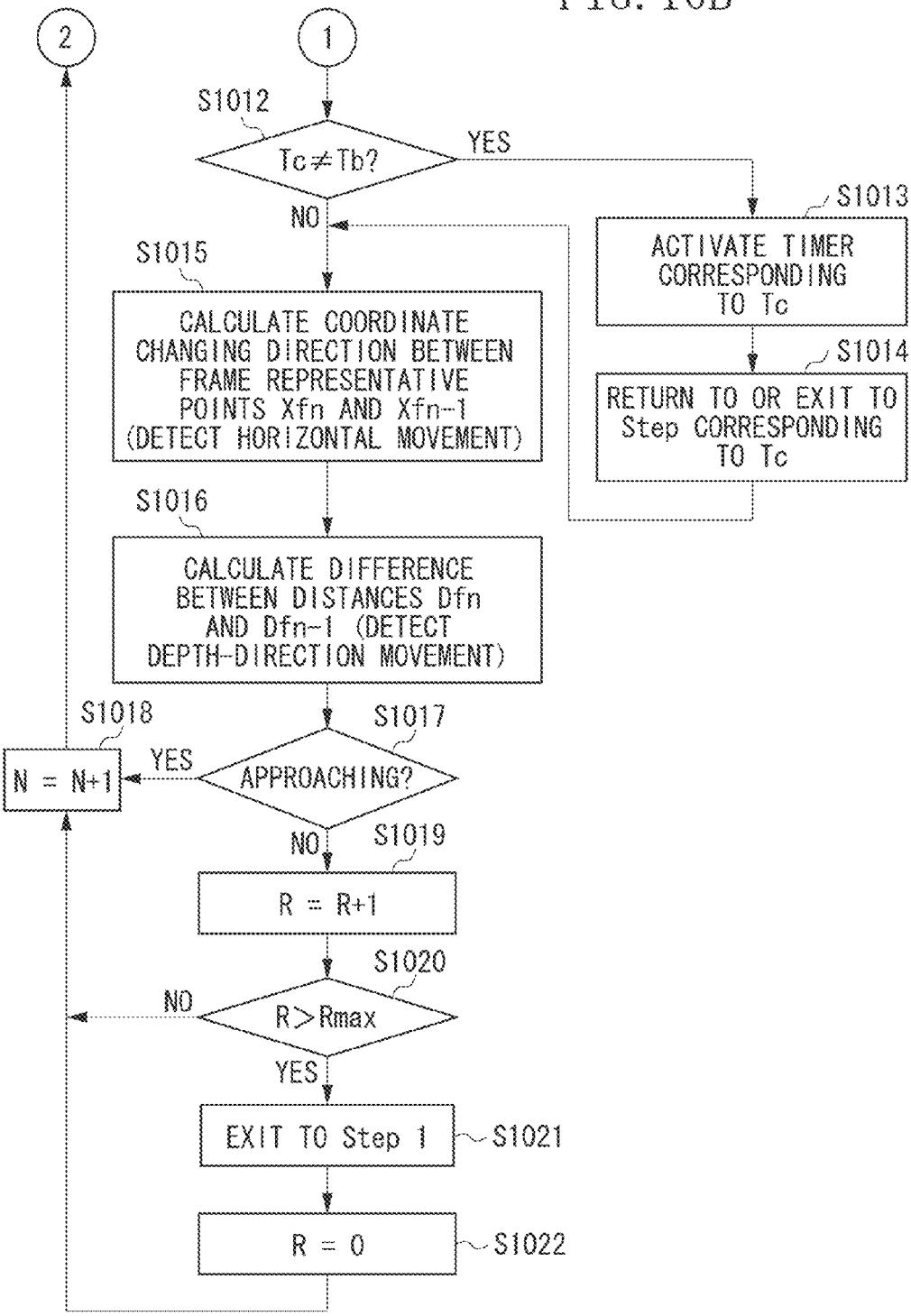

FIGS. 10 (A and B) is a flowchart illustrating a method for controlling the printing apparatus according to the present exemplary embodiment. An example of processing for recovering from or exiting to sleep using the human presence sensor 80 will be described. Though not illustrated, the determination unit 90 in the sensor unit 70 illustrated in FIG. 1 includes at least such components as a CPU for executing control and a nonvolatile memory. The nonvolatile memory of the determination unit 90 stores the various types of parameters 802 to 812 of the tables 801 and 804 described above referring to FIG. 8.

After the printing apparatus 10 has been activated, in step S1001, the determination unit 90 executes initial setting for performing processing for recovering from or exiting to sleep based on a person detection result of the human presence sensor 80, and the processing proceeds to step S1002. In the initial setting of step S1001, for example, when the ambient temperature at the activation time of the printing apparatus 10 is 25° C. as described above referring to FIG. 8, a preset value of the table 804 corresponding to 25° C. of the table 801 is read to prepare for executing processing for recovering from or exiting to sleep.

In step S1002, the determination unit 90 always monitors whether the printing apparatus 10 is in a sleep state. When the sleep determination is negative (NO in step S1002), in step S1003, the determination unit 90 executes initialization processing. When the initial setting has never been changed, the processing returns to step S1002 without executing any processing. When the sleep determination of the determination unit 90 is positive (YES in step S1002), the processing proceeds to step S1004 to execute heat source detection determination.

The determination unit 90 waits for heat source detection by the human presence sensor 80, in other words, detection of the human body 202. When the heat source detection determination is negative (NO in step S1004), in step S1005, the determination unit 90 executes the processing for exiting to Step 0 (sleep state) described above referring to FIGS. 9A to 9C. Through the initialization processing of step S1003, the processing returns to the sleep determination of step S1002. When no processing for recovering from sleep has ever been executed, no processing is executed in steps S1005 and S1003.

When the heat source detection determination by the determination unit 90 is positive (YES in step S1004), the processing proceeds to step S1006, and the determination unit 90 executes timeout determination.

When the result of the timeout determination by the determination unit 90 is positive (YES in step S1006), in step S1007, the determination unit 90 executes timer resetting processing. Then, in step S1008, the determination unit 90 executes processing for exiting to Step 1.

On the other hand, when the result of the timeout determination by the determination unit 90 is negative (NO in step S1006) (including a case where timer is not set), the determination unit 90 executes processing of steps S1009 to S1011.

In step S1009, the determination unit 90 calculates the representative points 602 of the Nth frame and an average temperature of the areas including the representative points as described above referring to FIGS. 6A to 6C and FIGS. 7A and 7B, and selects the Nth frame representative point Xfn 702 among the representative points 602. Then, in step S1010, the determination unit 90 calculates a distance Dfn between the Nth frame representative point Xfn and the reference point 503.

In step S1011, the determination unit 90 detects a current Tc zone by comparing the average temperature that is attribute information of the Nth frame representative point Xfn 702 described above referring to FIGS. 6A to 6C with the preset table 804.

In step S1012, the determination unit 90 compares the current Tc zone with a last Tb zone. When a result of the comparison is Tc≠Tb (YES in step S1012), the determination unit 90 sets Timeout 811 of the table 804 corresponding to the Tc zone.

In step S1013, the determination unit 90 executes timer activation processing, and executes processing for recovering from sleep up to a recovery level 809 corresponding to the Tc zone, or exiting processing of step S1014. When the result of the comparison is Tc=Tb (NO in step S1012), the determination unit 90 executes calculation of a coordinate changing direction between the N−1th representative point Xfn−1 and the Nth frame representative point Xfn described above referring to FIGS. 7A and 7B, in other words, horizontal movement detection processing of step S1015, and a difference between the N−1th frame Dfn−1 and the nth frame Dfn, in other words, depth movement detection processing of step S1016.

In step S1017, the determination unit 90 executes approaching determination. More specifically, the determination unit 90 determines whether the human body 202 as the heat source is approaching the printing apparatus 10 based on results of the horizontal movement detection and the depth movement detection of steps S1015 and S1016. When a result of the approaching determination by the determination unit 90 is positive (YES in step S1017), in step S1018, the determination unit 90 executes processing of N=N+1 for a variable N for managing nth frame processing, and the processing returns to the sleep determination of step S1002. Thereafter, the series of processes of steps S1002 to S1017 is executed for the N+1th frame.

On the other hand, when the result of the approaching determination is negative (NO in step S1017), in step S1019, the determination unit 90 adds +1 to an R value (R=R+1). In step S1020, the determination unit 90 compares the R value with the preset approaching degree index Rmax 812 (upper limit value) of the table 804. When a result of the comparison has not reached the upper limit value Rmax (NO in step S1020), the determination unit 90 executes the processing of step S1018, and then the processing returns to the sleep determination of step S1002.

On the other hand, when the result of the comparison by the determination unit 90 has reached the upper limit value Rmax (YES in step S1020), the determination unit 90 determines that the human body 202 is just a passerby and, in step S1021, executes exiting processing to Step 1. Then, in step S1022, the determination unit 90 initializes the R value (R=0), and the processing returns to the sleep determination of step S1002 via step S1018. By repeating the series of processes of steps S1002 to S1022 while the printing apparatus 10 is activated, processing for recovering from or exiting to sleep is executed.

According to the present exemplary embodiment, the printing apparatus can be recovered from the power-saving mode at a long distance between the printing apparatus and the human body.

Since recovering from or exiting to the power-saving mode can be accurately controlled in stages according to the distance, user convenience concerning the recovering from the power-saving mode and power saving of the printing apparatus can be simultaneously achieved.

The respective processes of the above-described exemplary embodiments can be achieved by a processing device (CPU or processor) such as a personal computer (computer) executing software (program) obtained via a network or various types of recording media.

The above-described exemplary embodiments are seen to be limiting. Various modifications (including organic combination of embodiments) can be made and not excluded from the scope of the present disclosure.

Other Embodiments

Additional embodiments can also be realized by a computer of a system or apparatus that reads out and executes computer executable instructions recorded on a storage medium (e.g., non-transitory computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-041684 filed Mar. 4, 2014, which is hereby incorporated by reference herein in its entirety.

What is claimed is:

1. A printing apparatus capable of shifting a power state to a second power state where power consumption is lower than a first power state, the printing apparatus comprising:

a detection unit configured to detect a heat source approaching the printing apparatus in an area divided into a predetermined number of areas for each passage of a predetermined period of time;

a first calculation unit configured to calculate an average temperature of respective areas including representative points specified from the predetermined number of divided areas detected by the detection unit;

a specifying unit configured to specify a current position of the heat source based on the average temperature of the respective areas calculated by the first calculation unit;

a second calculation unit configured to calculate a distance between the current position specified by the specifying unit and a predetermined reference point;

a first determination unit configured to determine whether the heat source is moving to pass by the printing apparatus based on a change of the current position specified by the specifying unit;

a second determination unit configured to determine whether the heat source is approaching the printing apparatus based on a change of the distance calculated by the second calculation unit; and a power control unit configured to shift, in a case where the second determination unit determines that the heat source is approaching the printing apparatus, the power state of the printing apparatus from the second power state to the first power state step by step according to the distance calculated by the second calculation unit, wherein the power control unit recovers the power state of the printing apparatus from the second power state to the first power state step by step according to a change level of the distance to the heat source approaching the printing apparatus.

2. The printing apparatus according to claim 1, wherein the power control unit starts, in a case where the change level is at a first step, power control preparation for supplying power to a user interface for receiving an operation of a user approaching the printing apparatus.

3. The printing apparatus according to claim 2, wherein the power control unit starts, in a case where the change level is at a second step where the heat source approaches nearer to the printing apparatus than at the first step, power control for supplying power to a user interface for receiving an operation of a user approaching the printing apparatus.

4. The printing apparatus according to claim 2, wherein the power control unit starts, in a case where the change level is at a third step where the heat source approaches nearer to the printing apparatus than at the first step, power control for supplying power to a controller for controlling the printing apparatus.

5. The printing apparatus according to claim 1, wherein, in a case where the change level is at a second or third step and a change where the heat source moves away from the printing apparatus occurs, the power control unit recovers the printing apparatus to a state where power control preparation for supplying power to a user interface for receiving an operation of a user approaching the printing apparatus is started.

6. The printing apparatus according to claim 1, wherein the second calculation unit calculates the distance between the current position specified by the specifying unit and the predetermined reference point based on a difference between an ambient temperature of the printing apparatus and a detection temperature detected by the detection unit.

7. The printing apparatus according to claim 1, wherein the detection unit is an infrared array sensor.

8. The printing apparatus according to claim 1, wherein the heat source is biological heat radiated from an operator of the printing apparatus.

9. A method for controlling a printing apparatus capable of shifting a power state to a second power state where power consumption is lower than a first power state, the method comprising:

detecting, with a detecting unit, a heat source approaching the printing apparatus in an area divided into a predetermined number of areas for each passage of a predetermined period of time;

executing a first calculation in which an average temperature of respective areas including representative points specified from the predetermined number of divided areas is calculated;

specifying a current position of the heat source based on the average temperature of the respective areas;

executing a second calculation in which a distance between the current position and a predetermined reference point is calculated;

executing a first determination whether the heat source is moving to pass by the printing apparatus based on a change of the current position;

executing a second determination whether the heat source is approaching the printing apparatus based on a change of the distance calculated in the second calculation;

shifting, in a case where it is determined in the second determination that the heat source is approaching the printing apparatus, the power state of the printing apparatus from the second power state to the first power state in stages according to the distance calculated in the second calculation, and recovering the power state of the printing apparatus from the second power state to the first power state step by step according to a change level of the distance to the heat source approaching the printing apparatus.

10. A computer readable storage medium storing computer executable instructions for causing a computer to execute a method for controlling a printing apparatus capable of shifting a power state to a second power state where power consumption is lower than a first power state, the method comprising:

detecting, with a detecting unit, a heat source approaching the printing apparatus in an area divided into a predetermined number of areas for each passage of a predetermined period of time;

executing a first calculation in which an average temperature of respective areas including representative points specified from the predetermined number of divided areas is calculated;

specifying a current position of the heat source based on the average temperature of the respective areas;

executing a second calculation in which a distance between the current position and a predetermined reference point is calculated;

executing a first determination whether the heat source is moving to pass by the printing apparatus based on a change of the current position;

executing a second determination whether the heat source is approaching the printing apparatus based on a change of the distance calculated in the second calculation;

shifting, in a case where it is determined in the second determination that the heat source is approaching the printing apparatus, the power state of the printing apparatus from the second power state to the first power state in stages according to the distance calculated in the second calculation, and recovering the power state of the printing apparatus from the second power state to the first power state step by step according to a change level of the distance to the heat source approaching the printing apparatus.

11. The method according to claim 9, further comprising executing power control preparation, in a case where the change level is at a first step, for supplying power to a user interface for receiving an operation of a user approaching the printing apparatus.

12. The method according to claim 9, further comprising recovering, in a case where the change level is at a second or third step and a change where the heat source moves away from the printing apparatus occurs, the printing apparatus to a state where power control preparation for supplying power to a user interface for receiving an operation of a user approaching the printing apparatus is started.

13. The method according to claim 9, wherein the executing second calculation includes calculating the distance between the specified current position and the predetermined reference point based on a difference between an ambient temperature of the printing apparatus and a detection temperature detected by the detecting.

14. The method according to claim 9, wherein the detecting is detected by an infrared array sensor.

15. The method according to claim 9, wherein the heat source is biological heat radiated from an operator of the printing apparatus.

16. The computer readable storage medium according to claim 10, further comprising executing power control preparation, in a case where the change level is at a first step, for supplying power to a user interface for receiving an operation of a user approaching the printing apparatus.

17. The computer readable storage medium according to claim 10, further comprising recovering, in a case where the change level is at a second or third step and a change where the heat source moves away from the printing apparatus occurs, the printing apparatus to a state where power control preparation for supplying power to a user interface for receiving an operation of a user approaching the printing apparatus is started.

18. The computer readable storage medium according to claim 10, wherein the executing second calculation includes calculating the distance between the specified current position and the predetermined reference point based on a difference between an ambient temperature of the printing apparatus and a detection temperature detected by the detecting.

19. The computer readable storage medium according to claim 10, wherein the detecting is detected by an infrared array sensor.

20. The computer readable storage medium according to claim 10, wherein the heat source is biological heat radiated from an operator of the printing apparatus.

* * * * *